US007686401B1

(12) United States Patent
Iannicelli

(10) Patent No.: US 7,686,401 B1
(45) Date of Patent: Mar. 30, 2010

(54) METHOD FOR SUB-GLACIAL MINERAL RECONNAISSANCE AND RECOVERY

(75) Inventor: Joseph Iannicelli, Jekyll Island, GA (US)

(73) Assignee: J.I. Enterprises, Inc., Brunswick, GA (US)

( * ) Notice: Subject to any disclaimer, the term of this patent is extended or adjusted under 35 U.S.C. 154(b) by 0 days.

(21) Appl. No.: 12/248,072

(22) Filed: Oct. 9, 2008

(51) Int. Cl.
*E21C 41/00* (2006.01)

(52) U.S. Cl. ..... 299/10; 299/17

(58) Field of Classification Search ..... 299/10, 299/17, 95

See application file for complete search history.

(56) References Cited

U.S. PATENT DOCUMENTS

| | | | | |
|---|---|---|---|---|
| 3,151,246 | A * | 9/1964 | Mardock | 250/303 |
| 4,267,446 | A | 5/1981 | Brown et al. | |
| 4,344,484 | A | 8/1982 | Ridley | |
| 4,536,035 | A | 8/1985 | Huffman et al. | |
| 4,537,062 | A | 8/1985 | Ernst | |
| 4,657,387 | A | 4/1987 | Heising et al. | |
| 4,934,466 | A | 6/1990 | Paveliev et al. | |
| 5,062,291 | A | 11/1991 | Asay | |
| 5,098,164 | A * | 3/1992 | Savanick et al. | 299/17 |
| 5,366,030 | A | 11/1994 | Pool, II et al. | |
| 5,435,628 | A | 7/1995 | Montgomery et al. | |
| 5,558,756 | A | 9/1996 | Blaricom | |
| 5,584,978 | A | 12/1996 | Van Blaricom | |
| 6,799,634 | B2 | 10/2004 | Hartog et al. | |
| 7,113,265 | B1 | 9/2006 | Sarrazin et al. | |
| 7,379,819 | B2 | 5/2008 | Betancourt et al. | |
| 7,402,797 | B2 | 7/2008 | Pemper et al. | |
| 2007/0128315 | A1 | 6/2007 | Szydlowski | |

FOREIGN PATENT DOCUMENTS

| | | | |
|---|---|---|---|
| WO | 9508694 | A1 | 3/1995 |
| WO | 2006023657 | A2 | 3/2007 |

OTHER PUBLICATIONS

Vogel, S.W., Tulaczyk, S., Engelhardt, H.; Bolsey, R.; Anderson, S.; Kamb, B. (2002), Studying the Subglacial Hydrological System In West-Antarctica—Opportunities And Challenges. Fastdrill—Workshop, Interdisciplinary Polar Research on Fast Ice-Sheet Drilling, Oct. 3-6, 2002, University of California Santa Cruz, CA.*

Drilling below the Arctic ice, Mining and Construction Jan. 2004.*

SME Mining Engineering handbook, Hartman, et al. 1992 pp. 243, 249, and 253.*

Faris, Stephan, "Ice Free, Will global warming give Greenland its independence?" (Jul. 27, 2008), Phenomenon, p. 20.

* cited by examiner

*Primary Examiner*—John Kreck
(74) *Attorney, Agent, or Firm*—Banner & Witcoff, Ltd.

(57) ABSTRACT

A method for sub-glacial mineral reconnaissance and recovery comprises analyzing silt and solutes in fluvial sub-glacial streams of a glacier. Boreholes are formed in the glacier and melt-water flow is analyzed to establish concentration gradients of minerals in the solutes and sediments. After significant mineral deposits are identified, conventional mining techniques may be used to recover minerals.

15 Claims, 2 Drawing Sheets

METHOD FOR SUB-GLACIAL MINERAL RECONNAISSANCE AND RECOVERY

DESCRIPTION OF RELATED ART

Glaciers in mountainous regions of all continents overlie vast areas comprising many thousands of square miles that potentially harbor massive, diverse, and valuable mineral deposits. These deposits have hitherto been generally unavailable to exploration and recovery by current methods because of such factors as inaccessibility, poor logistics, exorbitant expense, and environmental considerations.

Most of the earth's 160,000 glaciers have been shrinking and thinning at an ever-accelerating rate for most of a century due to climate warming. The melt rate has dramatically increased during the past decade, and many glaciers have already vanished.

Voluminous literature has been published on many aspects of glacial studies and science, but no specific references have been found with respect to mineral prospecting and recovery from sub-glacial melt water and sediments.

In 1941, prospectors staked a number of claims around a molybdenum moraine deposit, but no significant mining activity resulted.

In 1958, a crew of mineral explorers from Fremont Mining found a mineralized rock cropping or "nunatak" protruding more than 1,000 feet above sea level on the vast Brady Icefield in Glacier Bay National Park and Preserve. Test drills were made through 300 to 400 feet of ice into bedrock beneath the glacier.

In 1971, Newmont Exploration Ltd. disclosed a plan to bore a three mile tunnel under the Brady Icefield. Environmental concerns have put on hold these and other prospects in Glacier Bay National Park and Preserve.

SUMMARY

In one aspect, a method for sub-glacial mineral reconnaissance and recovery comprises analyzing silt and solutes in fluvial sub-glacial streams of a glacier, forming holes in the glacier, and analyzing melt-water flow to establish concentration gradients of minerals in the solutes and sediments. The holes in the glaciers may be formed by melting with solar energy, or by other techniques such as boring. After significant mineral deposits have been identified, conventional mining techniques may be used for recovering minerals.

In other aspects, a soluble tracer may be introduced into the holes to quantify flow rates in the sub-axial and sub-lateral melt water flows. Hydraulic mining techniques may be used to recover solutes, silts, and sediments. In addition, robotic tools may be used to collect and dredge minerals.

The sub-glacial exploration and recovery method as described herein is a useful and promising new tool in mineral exploration because it is more rapid and less expensive than conventional hard rock prospecting, drilling, core comminution, and analysis.

DETAILED DESCRIPTION

Unless indicated otherwise, all percentages referred to herein are on a weight (w/w) basis.

Figure 1:
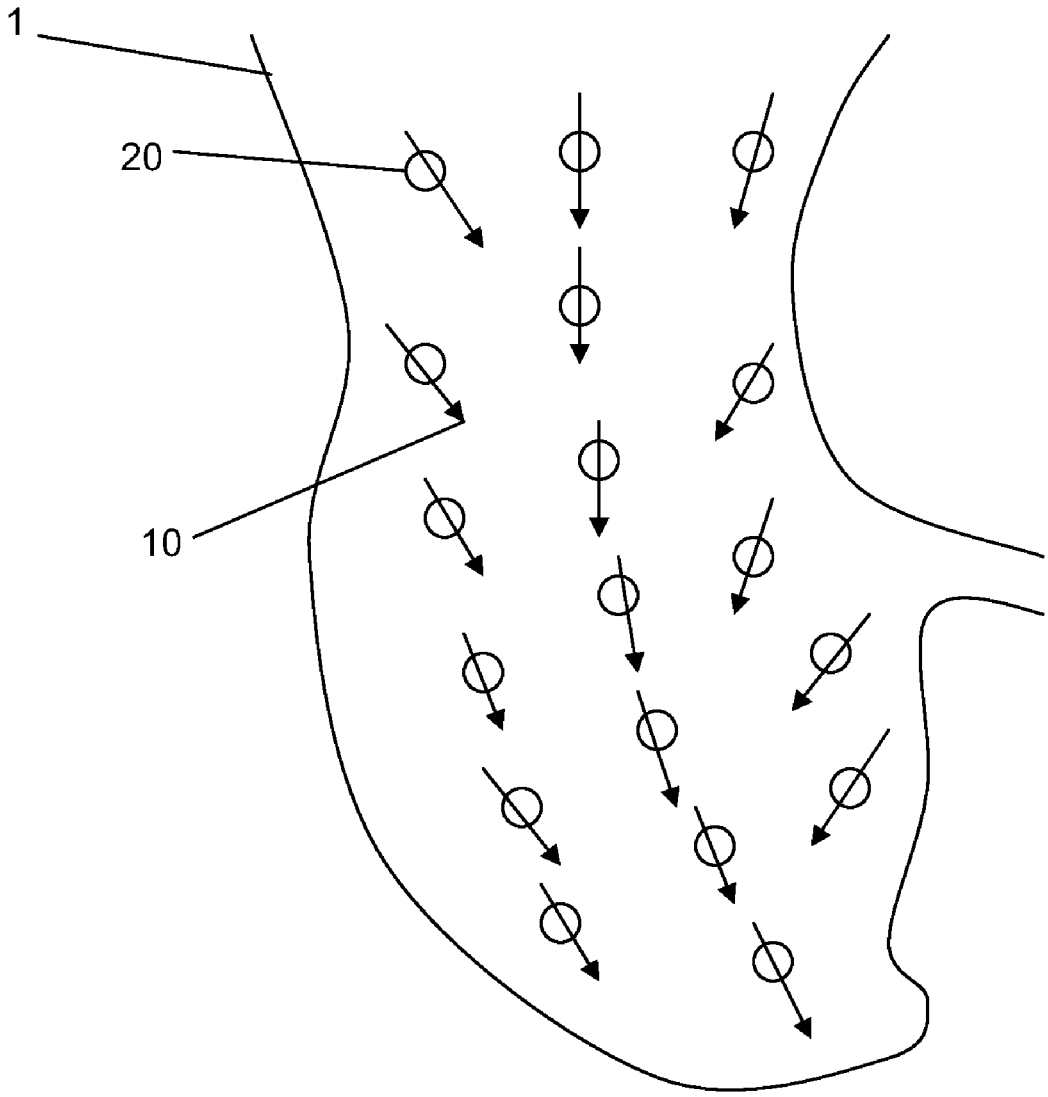
FIG. 1 is a schematic diagram of a glacier with melt water flows indicated and which are intercepted by boreholes through the ice for collection of melt water and sub-glacial sediments.
Figure 2:
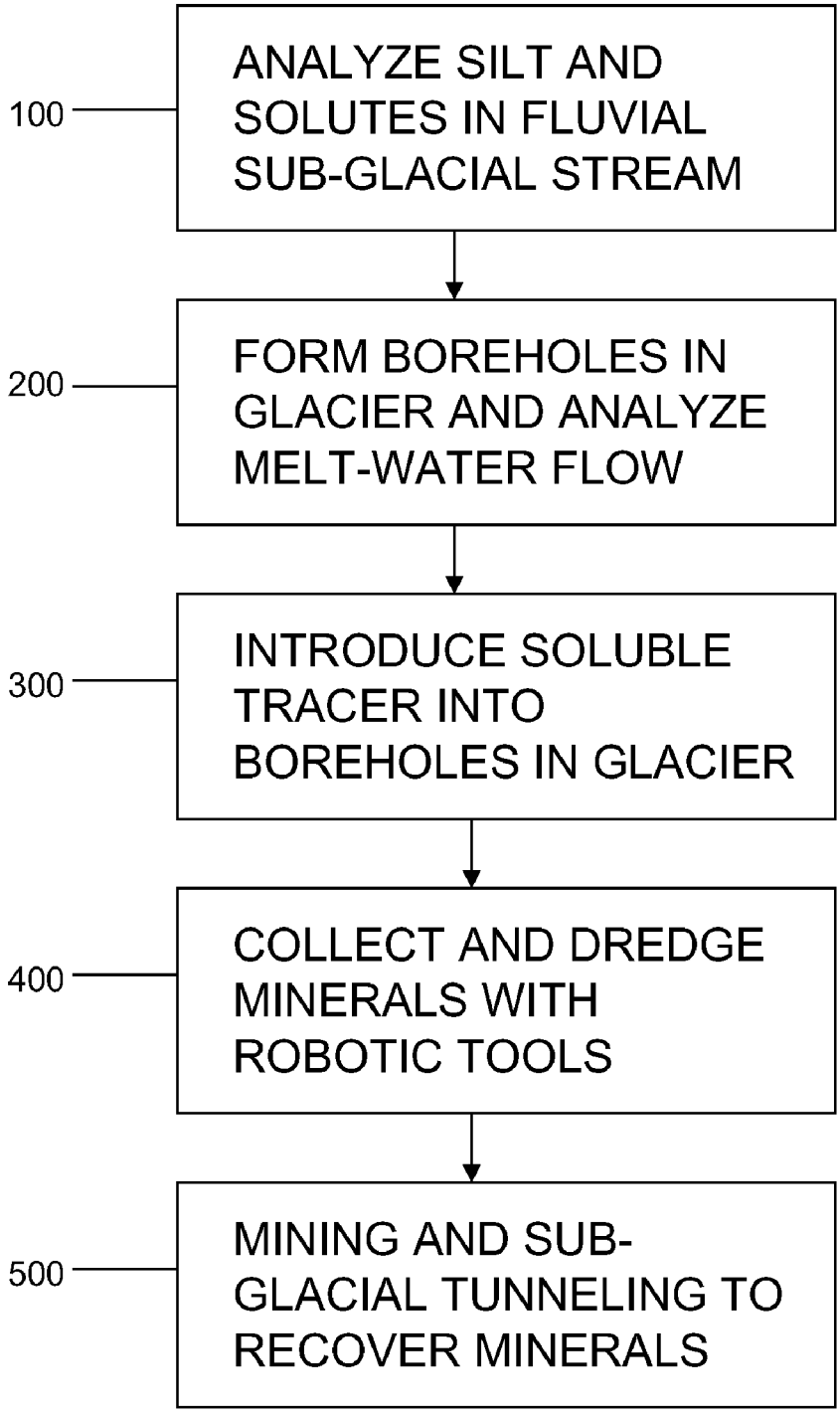
FIG. 2 is a flow diagram of a method for sub-glacial mineral reconnaissance and recovery according to one embodiment of the invention.

With reference to FIG. 1, a sub-glacial mineral reconnaissance and recovery method comprises analyzing silt and solutes in fluvial sub-glacial streams of a glacier 1. The silt and solutes are typically analyzed at the moraine terminus of a glacier 1 for mineral concentration anomalies. This step is illustrated in FIG. 2 as step 100.

Boreholes 20 may be formed along the axis and breadth of the glacier 1. The term "boreholes" refers to holes formed by boring or other techniques, such as melting with a concentrated form of solar energy or the like. The melt-water flow 10 beneath the boreholes 20 may be analyzed at various locations along the glacier 1 to establish concentration gradients of minerals in the solutes and sediments. If melt water flow 10 is insufficient, supplemental water may be pumped down one borehole 20 and pumped out from adjacent boreholes 20. This step is illustrated in FIG. 2 as step 200.

A soluble tracer may be introduced into the boreholes 20 to quantify flow rates in sub-axial and sub-lateral melt water flows 10. Non-limiting examples of materials that may be used as tracers include dyes and safe radioisotopes such as fluorescein, aurin, and iodine ($I^{125}$) and carbon ($C^{14}$) radioisotopes. This step is illustrated in FIG. 2 as step 300.

When appropriate, hydraulic mining techniques may be used to recover solutes, silts, and sediments of economic value from the sub-glacial melt water. Supplemental water may be introduced into the boreholes 20 to suspend the sediment, if necessary. Supplemental hydraulic mining and sampling techniques with drill cores (either vertical or horizontal) may be used, particularly when significant anomalies of economic value have been identified in local melt water 10 and/or sediments.

Robotic tools may be employed to collect and dredge fine minerals. This step is illustrated in FIG. 2 as step 400. Robotic X-ray fluorescence (XRF) and/or X-ray diffraction (XRD) may be used to analyze sub-glacial minerals. The data obtained may be recorded for future reference to recover minerals after the glacier retreats.

When significant mineral deposits have been identified, conventional mining techniques may be used to recover minerals. Such mining may involve sub-glacial tunneling. This step is illustrated in FIG. 2 as step 500. Areas of economic mineralization may be delineated and recorded for further conventional mining after the glacier retreats.

Glacier melt acceleration actually improves access to glacial melt water. However, once glaciers have melted and completely disappeared, it will be necessary to revert to conventional practice of prospecting, followed by hard rock drilling on a matrix of former glacier valleys. It will be appreciated that sub-glacial mineral inventory as described herein may significantly simplify mineral exploration after a glacier has melted and disappeared.

Example 1

The following example is provided for illustrative purposes only and should not be construed as limiting the scope of the present invention as described and claimed herein.

Melt water and silt samples were collected from the terminal moraine of a retreating glacier in an environmentally sensitive area in the United States which is referenced as Glacier 82808. The silt samples were screened and the minus 100 mesh fraction was analyzed by standard XRF methods. Results of this analysis are shown in Table 1 (minor elements) and Table 2 (major elements).

In Table 1, for each of the elements found in the silt, the corresponding relative abundance of each element in the Earth's lithosphere is listed.

TABLE 1

| Element | Sediment Concentration (ppm) | Relative Abundance in Lithosphere (ppm)[a] |
|---|---|---|
| V | 60 | 210 |
| Cr | 55 | 370 |
| Co | 11 | 23 |
| Ni | 12 | 80 |
| Cu | 22 | 70 |
| Zn | 69* | 1 |
| Sn | 62* | 40 |
| Pb | 46* | 16 |
| Sr | 63 | 180 |
| Zr | 202± | 280 |
| Rb | 131* | 3 |
| Y | 27± | 28 |
| Ce | 190* | 46.1 |
| La | 51* | 18.3 |
| Nd | 69* | 23.9 |

[a]Langes Handbook of Chemistry, Tenth Edition, p. 163
*Significant enrichment compared to relative abundance
±Concentration in same range as relative abundance

TABLE 2

| Compound | Concentration (wt. %) |
|---|---|
| $Na_2O$ | 0.63 |
| MgO | 7.75 |
| $Al_2O_3$ | 11.20 |
| $SiO_2$ | 60.50 |
| $P_2O_5$ | 0.13 |
| S | <0.05 |
| Ce | <0.02 |
| $K_2O$ | 3.12 |
| CaO | 6.80 |
| $TiO_2$ | 0.54 |
| MnO | 0.07 |
| $Fe_2O_3$ | 3.55 |
| BaO | 0.06 |

Results of the analyses in Table 1 show a significant concentration of rare earth elements Y, Ce, La, Nd, as well as concentrations of Zn, Sn, Pb, Zr, and Rb. These results would warrant follow up sub-glacial sampling in boreholes to identify localized concentrations of the above metal values. Once such concentrations are identified, they could be recovered by the hydraulic mining methods described herein. The reconnaissance information would also be of value for conventional mining methods or modification of such methods (e.g., tunneling under the glacier or post-glacier mining).

Results in Table 1 also show traces of V, Cr, Co, Ni, Cu, and Zr. While concentrations of these elements are less than their relative abundance in the earth's lithosphere, these metals may indicate larger commercial concentrations that could be identified by systematic sampling of melt water form a matrix of boreholes in the glacier.

Data in Table 2 from analysis of the same terminal moraine sample 82808 show that no significant anomalies exist except for barium oxide (0.06% BaO or 0.054% Ba). The average content of Ba in the earth's lithosphere is 0.048%.

While particular embodiments of the present invention have been described and illustrated, it should be understood that the invention is not limited thereto since modifications may be made by persons skilled in the art. The present application contemplates any and all modifications that fall within the spirit and scope of the underlying invention disclosed and claimed herein.

What is claimed is:

1. A method for sub-glacial mineral reconnaissance and recovery comprising:

i. forming boreholes in a glacier and analyzing solutes and sediments in sub-glacial melt-water flow;

ii. establishing concentration gradients of minerals in the solutes and sediments;

iii. identifying from the concentration gradients significant mineral deposits of economic value; and iv. recovering the solutes and sediments.

2. The method of claim 1, wherein the solutes and sediments are analyzed at the moraine terminus of a glacier for mineral concentration anomalies.

3. The method of claim 1, wherein solar energy is used for melting the boreholes in the glacier.

4. The method of claim 1, further comprising introducing a soluble tracer into the holes to quantify flow rates in the sub-axial and sub-lateral melt water flows.

5. The method of claim 1, wherein the solutes and sediments are recovered using hydraulic mining techniques.

6. The method of claim 1, further comprising collecting and dredging minerals with robotic tools.

7. The method of claim 1, further comprising forming horizontal or vertical drill cores.

8. The method of claim 1, further comprising analyzing sub-glacial minerals using at least one of X-ray fluorescence (XRF) and X-ray diffraction (XRD).

9. The method of claim 1, further comprising recovering mineral deposits using conventional mining techniques.

10. The method of claim 9 wherein sub-glacial tunneling is used to recover mineral deposits.

11. A method for sub-glacial mineral reconnaissance and recovery comprising:

i. analyzing a fluvial sub-glacial stream of a glacier for mineral concentration anomalies;

ii. forming boreholes in the glacier and analyzing solutes and sediments in melt-water flow to establish concentration gradients of minerals in the solutes and sediments;

iii. introducing a soluble tracer into the holes to quantify flow rates in the sub-axial and sub-lateral melt water flows;

iv. determining from the concentration gradients significant mineral deposits of economic value;

v. recovering solutes and sediments with hydraulic mining techniques; and vi. recovering mineral deposits using conventional mining techniques.

12. The method of claim 11, wherein solar energy is used for melting the boreholes in the glacier.

13. The method of claim 11, further comprising collecting and dredging minerals with robotic tools.

14. The method of claim 11, further comprising forming horizontal or vertical drill cores.

15. The method of claim 11, further comprising analyzing sub-glacial minerals using at least one of X-ray fluorescence (XRF) and X-ray diffraction (XRD).

* * * * *